United States Patent [19]

Alper et al.

[11] 4,075,801

[45] Feb. 28, 1978

[54] STORAGE TANKS

[75] Inventors: Marc H. Alper, Creve Coeur; Ernest J. Koestering, Kirkwood, both of Mo.

[73] Assignee: Philip D. Mogler, Lester, Iowa

[21] Appl. No.: 741,962

[22] Filed: Nov. 15, 1976

[51] Int. Cl.[2] ..... E04H 12/16

[52] U.S. Cl. ..... 52/196; 52/224; 52/236.2; 52/264

[58] Field of Search ..... 52/245, 246, 247, 248, 52/249, 292, 296, 227, 282, 236.1, 82, 293, 294, 299, 236.2, 236.9, 236.3, 224

[56] References Cited

U.S. PATENT DOCUMENTS

| | | | |
|---|---|---|---|
| 1,137,842 | 5/1915 | Cram | 52/227 |
| 1,254,131 | 1/1918 | Flynn | 52/247 |
| 1,316,768 | 9/1919 | Cooper | 52/192 |
| 1,882,942 | 10/1932 | Ross | 52/196 |
| 2,775,794 | 1/1957 | Keely | 52/82 |
| 3,354,590 | 11/1967 | Gilroy | 52/299 |
| 3,490,186 | 1/1970 | Hammond | 52/293 |
| 3,530,628 | 9/1970 | Ferris | 52/248 |
| 3,605,342 | 9/1971 | Koser | 52/248 |
| 3,640,038 | 2/1972 | Heron | 52/248 |
| 3,685,232 | 8/1972 | Steffen | 52/245 |

FOREIGN PATENT DOCUMENTS

| | | | |
|---|---|---|---|
| 201,032 | 2/1956 | Australia | 52/223 R |

*Primary Examiner*—John E. Murtagh
*Attorney, Agent, or Firm*—Richard J. Sher

[57] ABSTRACT

Tanks for storing materials, especially liquid and semi-liquid materials. The tank wall is formed of a plurality of arcuate panels, each fabricated from vertically stacked precast concrete panel sections, which are joined by vertical pilasters, each pilaster formed from precast concrete pilaster sections. The wall is prestressed by tensioned tendons disposed on the periphery thereof. Each of the pilasters are supported by a separate footing and the ends of the arcuate panels are likewise supported on the footings. The footings are interconnected by a novel stabilizing structure to withstand seismic loading. These as well as numerous other novel structural features provide for a storage tank of modular construction, which is strong, stable and versatile; which may be constructed in a facile manner; and which may, if desired, be easily dismantled for relocation.

21 Claims, 15 Drawing Figures

STORAGE TANKS

BACKGROUND AND SUMMARY OF THE INVENTION

The present invention relates to storage tanks which may be used to store liquid or semi-liquid substances. Although a tank constructed according to the principles of the invention may be utilized for storing a wide variety of materials, it is particularly adaptable for use as a farm manure bank. As the price of artificial fertilizers rises, it has become increasingly advantageous for farmers to store manure for subsequent soil fertilization. A number of storage tank structures have been available for use as manuare banks; however, they have been found to be unsatisfactory for a variety of reasons, such as necessitating expensive equipment and/or skilled labor for construction; unsafe in seismically active locations; inability to enlarge the capacity of the tank or relocate the tank; susceptable to corrosion failure.

The preferred embodiment of the storage tank according to the present invention includes a plurality of arcuate wall panels, each formed of a plurality of superimposed precast concrete panel sections, joined end to end by vertically extending pilasters to form a cylindrical tank wall. The tank is versatile due to the modular construction thereof; i.e., the height of the tank wall is determined by the number of superimposed panel sections which are utilized. For example, if a fifteen foot high tank is desired, the wall may be constructed of panels comprised of three superimposed panel sections, each section of five foot height. Further, if it is subsequently desired to increase the capacity of the tank by increasing the height of the tank wall to, for example, twenty feet, this can be achieved by the simple addition of one five footh high section to each wall panel. The tank wall is supported in a novel fashion by a plurality of circumferently spaced concrete footings located beneath each vertical pilaster. The footings are formed separate from the tank floor but are interconnected through radially directed spokes to facilitate the capability of the tank to withstand a greater degree of seismic loading than was heretofore known. The tank floor may be formed from a poured-in-place concrete slab after construction of the tank wall, eliminating the need for the construction of a circular form, or the floor may be fabricated at least in part from precast concrete elements.

The cylindrical wall of the tank if prestressed in anticipation of the forces generated by the material to be stored by the provision of vertically spaced wires or tendons tensioned around the tank periphery. The vertical spacing of the tendons is varied according to the computed force load along the vertical extent of the wall and the tendons are secured to two diametrically opposite stressing pilasters. The possibility of progressive failure of the tank due to implosion forces in the event that a single panel section should fail is negated by the fact that the pilasters are post-tensioned vertically and capable of resisting implosion due to a sudden emptying of the tank due to failure of one of the sections. If such an event should occur the tank will be repairable rather than totally demolished.

It is therefore the primary object of the invention to provide a storage tank having a novel modular construction which is versatile in utilization, structurally sound, and is facile and economical in fabrication and relocation.

This as well as other objects and advantages will become more apparent upon a reading of the hereinbelow described preferred embodiment of the invention in conjunction with the drawings wherein.

DESCRIPTION OF THE PREFERRED EMBODIMENTS

With reference to the drawings, the construction of a tank according to the teachings of the invention is illustrated. It is pointed out that while a tank of approximately 80 feet in diameter and approximately 20 feet in height is contemplated, the drawings do not reflect these proportions for the reason of clarity in description.

Figure 3:
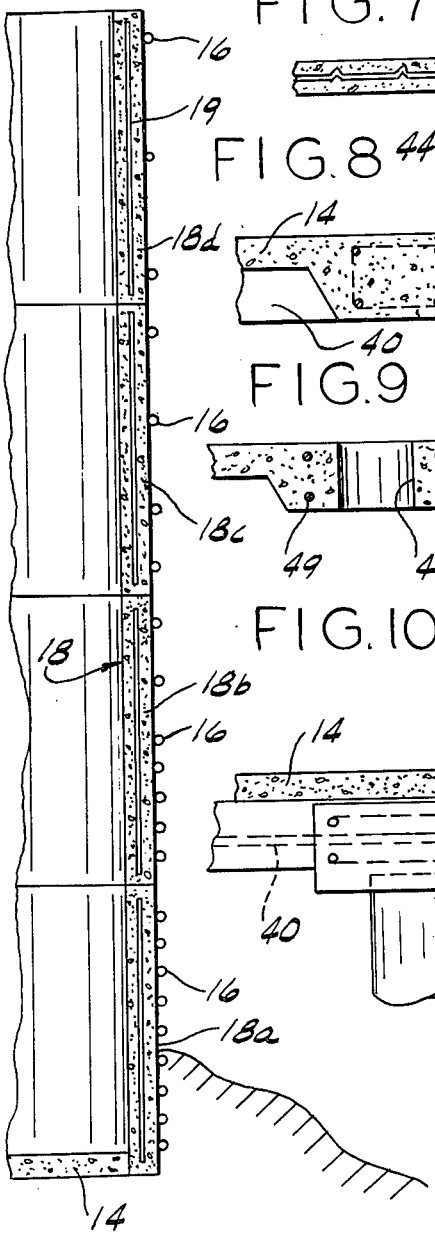
FIG. 3 is an enlarged vertical cross section taken along line 3—3 of FIG. 2.
Figure 7:
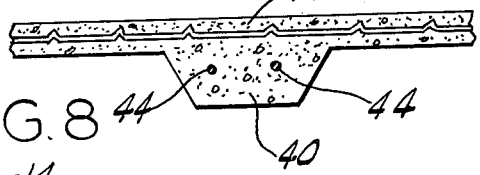
FIG. 7 is an enlarged vertical cross section of a portion of one preferred embodiment of the tank floor taken on line 7—7 of FIG. 2.
Figure 8:
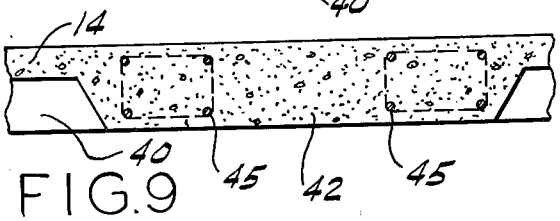
FIG. 8 is an enlarged vertical cross section of the preferred embodiment of the tank floor taken on line 8—8 of FIG. 2.

The tank 10 is comprised basically of a cylindrical wall 12, a floor 14 and a plurality of vertically spaced tensioned wires or tendons 16 around the entire periphery of the wall 12. Wall 12 is comprised of a plurality of wall panels 18, each identical in construction and fabricated from a plurality of vertically stacked precast concrete panel sections 18*a*, 18*b*, 18*c*, 18*d* (FIG. 3). Each of the panel sections 18*a*, 18*b*, 18*c*, 18*d* of each wall panel 18 is identical to the others and is sized to require a minimum of panel sections to complete the tank while being conducive to delivery and placement with only light duty contruction equipment. The panel sections each contain interior metal reinforcement 19 in accordance with well known engineering practices.

Figure 1:
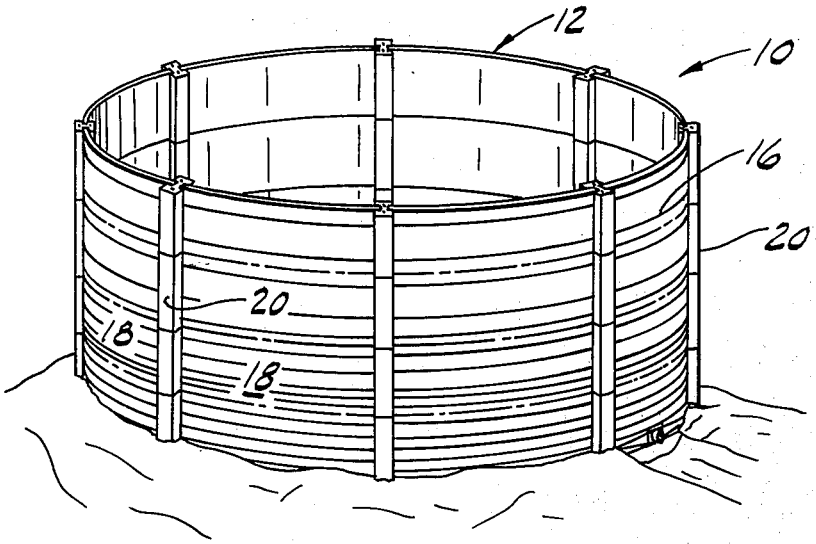
FIG. 1 is a perspective view of a tank constructed according to the principles of the invention.
Figure 4:
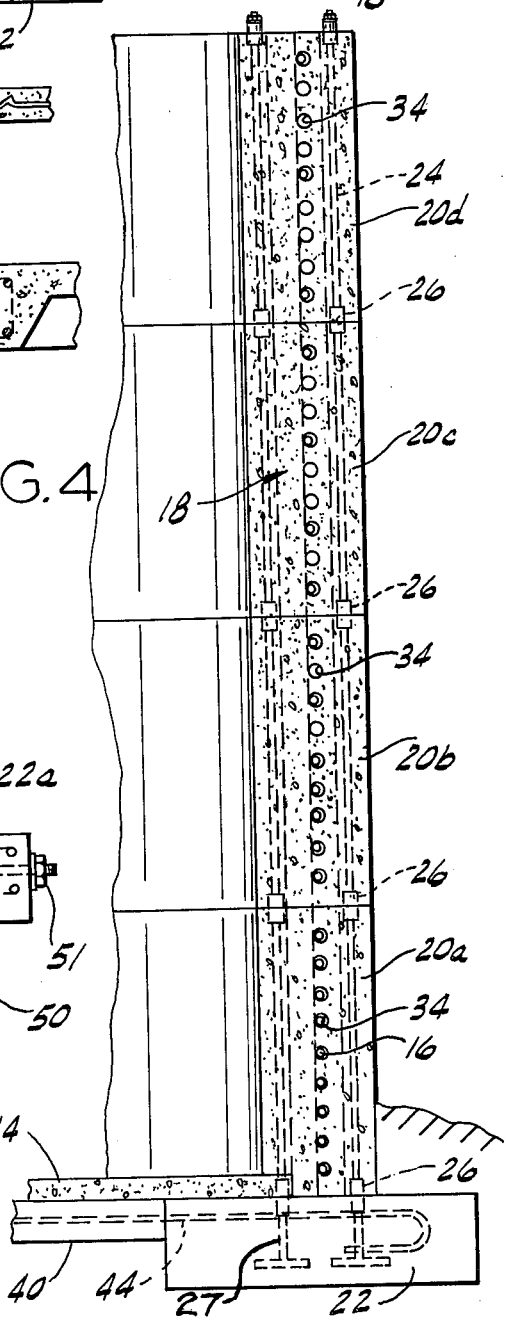
FIG. 4 is an enlarged vertical cross section taken along line 4—4 of FIG. 2.

As shown in the drawings, the panels 18 are joined end to end by vertical concrete pilasters 20. The adjacent ends of panels 18 as well as each pilaster 20 are supported on an individual respective concrete footing 22. As shown in FIGS. 1 and 4, the footings and wall panels are buried beneath the surface of the earth a sufficient distance so that the ground beneath will not freeze and apply an upward force on the tank wall. Pilasters 20 are each constructed of vertically connected identical pilaster sections 20*a*, 20*b*, 20*c*, 20*d* (FIG. 4) which are each of precast concrete with metal reinforcement 21 (FIG. 5) and are each of equal height with the panel sections 18*a*, 18*b*, 18*c*, 18*d*. Each pilaster section is provided with a pair of radially spaced, vertical bores 22 therethrough, each of which contain a metal connecting rod 24 for securing the bottom pilaster section 20*a* to the subjacent footing 22 and the superimposed pilaster sections 20*b*, 20*c*, 20*d* to the respective adjacent ends thereof. Preferrably, the connecting rods 24 are of the type known as Dywidag threaded bars which may be coupled by internally threaded sleeve connectors schematically shown at 26. It is noted that the lowermost connectors 26 are connected to the exposed upper end of respective threaded bars 27 which are anchored in concrete footings 22. After assembly of the pilasters the connecting rods 24 are post-tensioned in a conventional manner.

Figure 5:
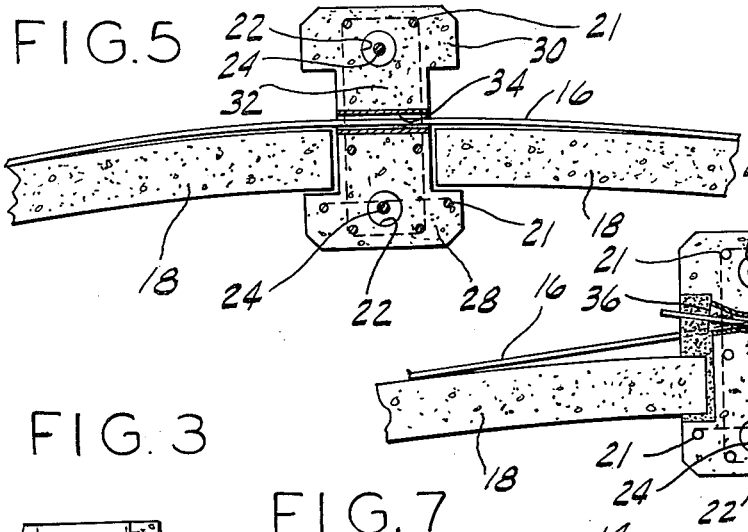
FIG. 5 is an enlarged horizontal cross section of a portion of the tank wall, including a non-stressing pilaster.

The pilasters 20 all have a substantially I-beam cross section with an internal flange portion 28, an external flange portion 30 and a midportion 32 joining the internal and external portions. FIGS. 4 and 5 show a typical non-stressing pilaster including a plurality of equally vertically-spaced, metal-lined, horizontal cross bores 34. Cross bores 34 allow unencumbered passage therethrough of tendons 16 and are positioned flush with the external surface of wall panels 18. As shown in FIG. 4, the spacing of tendons 16 is progressively increased from the bottom of the tank to the top due to the greater load forces experienced by the wall at the bottom when the tank is in use.

Figure 6:
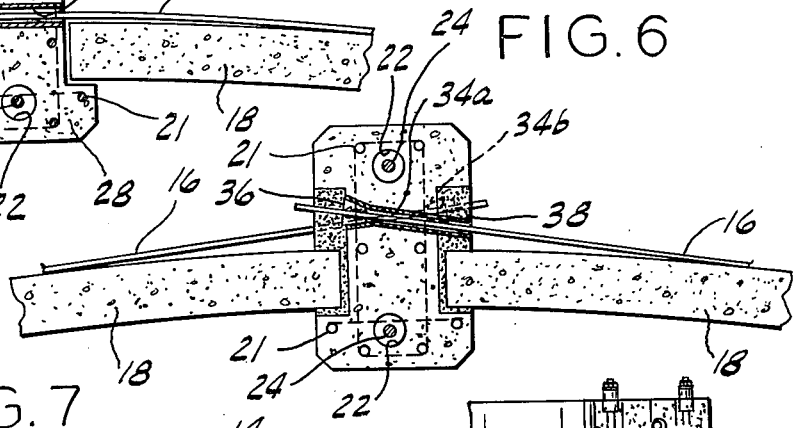
FIG. 6 is a view similar to FIG. 5 showing a portion of the tank wall including a stressing pilaster.

FIG. 6 shows one of two diametrically opposed stressing pilasters 20*s* which have a slightly modified cross bore design for the purpose of tensioning and securing tendons 16 during construction. In stressing pilaster 20*s* there are provided two angled cross bores 34*a* and 34*b* at the approximate level of each of the flush cross bores 34 in the non-stressing pilasters. Cross bores 34*a* and 34*b* are angled in opposite directions with respect to the external surface of the wall panels 18 in order to accommodate the ends of tendons 16 as they are pulled outwardly by hydraulic jacks, or the like, during tensioning of tendons 16. After tendons 16 are tensioned with sufficient force serrated wedges 36 are inserted in the bores 34*a*, 34*b* and hydraulically seated to hold tendons 16 and thereby prevent the withdrawal thereof from the bores 34*a*, 34*b*. Thereafter, a common grouting material 38 may be applied as shown in FIG. 6 to protect the anchorage. Also, FIG. 6 illustrates that grouting 38 may be utilized to provide a liquid tight seal between wall panels 18 and pilasters 20 at all locations if desired. It is noted, however, that in the case of manure storage, the manure will harden to self-seal the crevices between the vertically stacked wall panel sections and other abutments, if leakage should begin.

In the embodiments of FIGS. 2, 7, 8 and 9, tank floor 14 is a poured-in-place concrete structure entirely formed within the confines of the tank wall 18. Floor 14 includes an integral stabilizing structure having radially-directed, elongated struts or spoke portions 40 which extend between a respective footing 22 and a depending central hub portion 42. Internal metal reinforcement 44 connects each footing 22 with the metal reinforcement 45 of hub portion 42. This construction provides for an extremely stable structure which is capable of withstanding greater seismic loading by helping to maintain the circular profile of footings 22 and which helps prevent the tank wall from deforming due to lateral loading.

Figure 9:
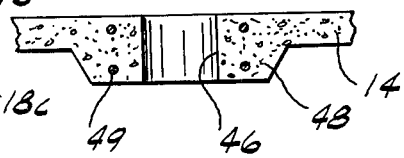
FIG. 9 is an enlarged vertical cross section of the preferred embodiment of the tank floor taken on line 9—9 of FIG. 2.

FIG. 9 illustrates a tank bottom inlet port 46 having a thickened annular wall 48 integral with floor 14. Inlet port 46 includes annular metal reinforcement 49 and may be connected to an underground pipe in any conventional manner for the introduction of material into the tank.

Figure 11:
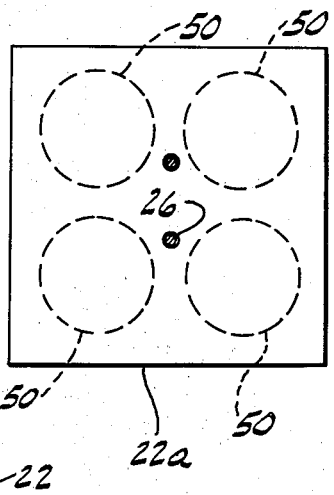
FIG. 11 is a top plan view of the footing structure of FIG. 10.
Figure 10:
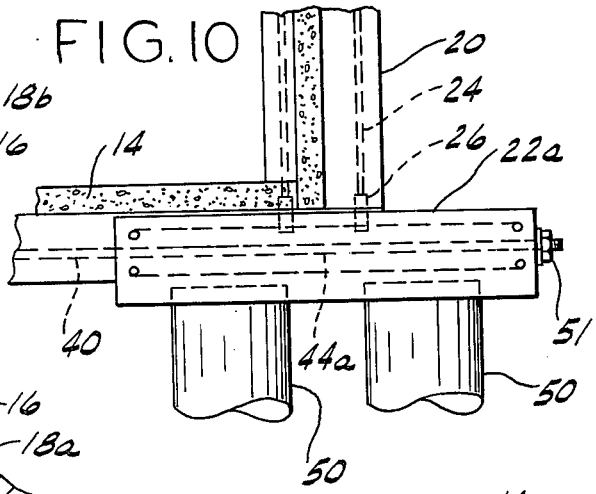
FIG. 10 is a side elevation partly in section of an alternate footing structure.

FIGS. 10 and 11 show a modified form of footing structure 22*a* having four depending piers 50 for providing additional support in geophysically poor areas. Each of the piers is eighteen inches or less in diameter to facilitate the drilling of pier bore holes into the ground with standard, easily obtainable rural boring machinery. Also, FIG. 10 suggests an alternative reinforcing structure including an external anchoring member 51 for post tensioning metal bar 44*a* running through spoke 40 and footing 22*a*.

Figure 13:
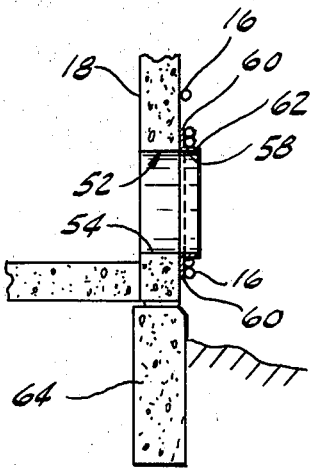
FIG. 13 is a section taken along line 13—13 of FIG. 12.
Figure 12:
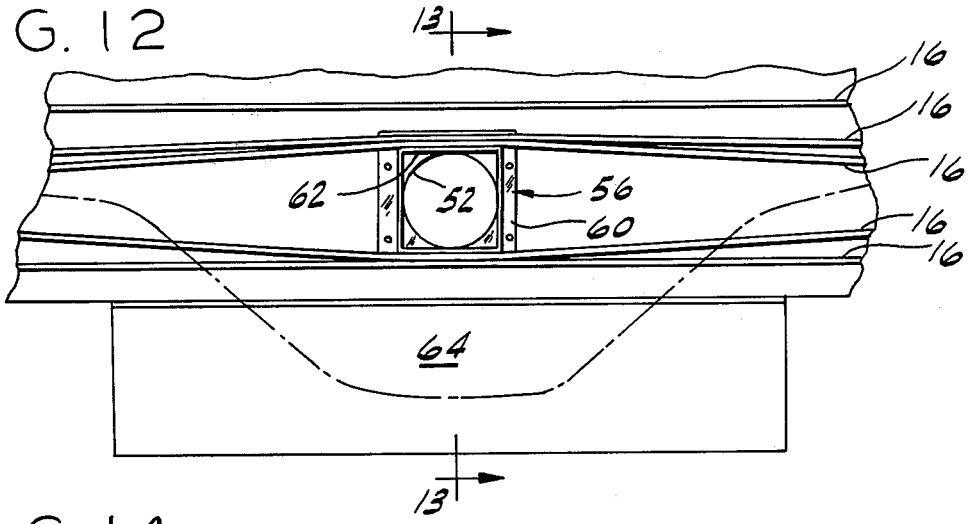
FIG. 12 is a side elevation of the wall area adjacent to the tank outlet port.

FIGS. 12 and 13 illustrate the structure of a tank outlet port 52 in the wall 18 of tank 10. Outlet port 52 includes a bore 54 in the tank wall 18 and a metal member 56 having a central passage 58 coaxially located with respect to bore 54. Member 56 includes a peripheral flange 60 which may be secured to the exterior surface of wall 18 in any well known manner and an outwardly extending lip 62 which acts to spread the tendons 16, which would normally pass across the bore 54, both above and below the bore 54. An outlet pipe (not shown) may be connected to the outlet port 52. Due to the fact that the outlet port must be located at the bottom of tank 10, it is necessary to provide a frost wall 64 below tank wall 18 at the location where the ground (shown in dotted line in FIG. 12) is recessed. Frost wall 64 extends deep enough beneath tank wall 18 to prevent surface ground freezing from applying an upward force to tank wall 18.

Figure 14:
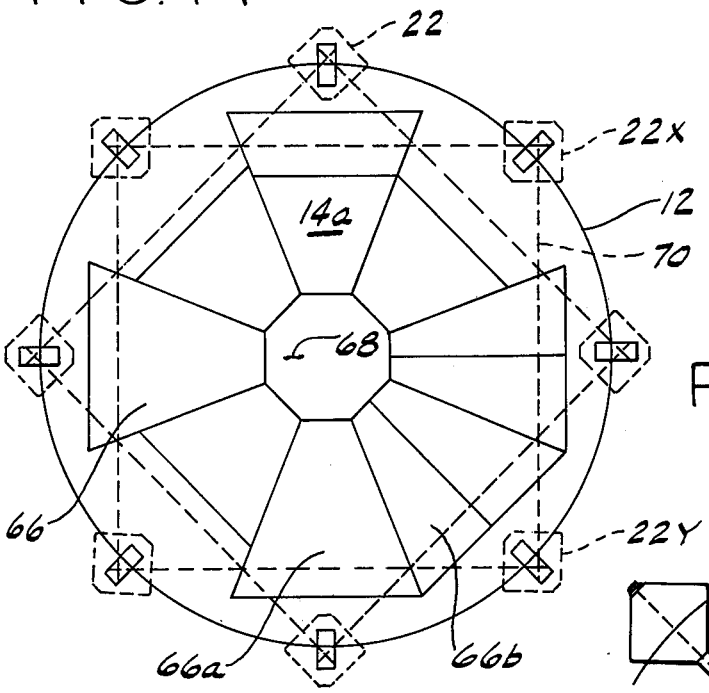
FIG. 14 is a schematic plan view of an alternate embodiment of the floor structure; and, FIG. 15 is a schematic bottom view of an alternate stabilizing substructure.
Figure 15:
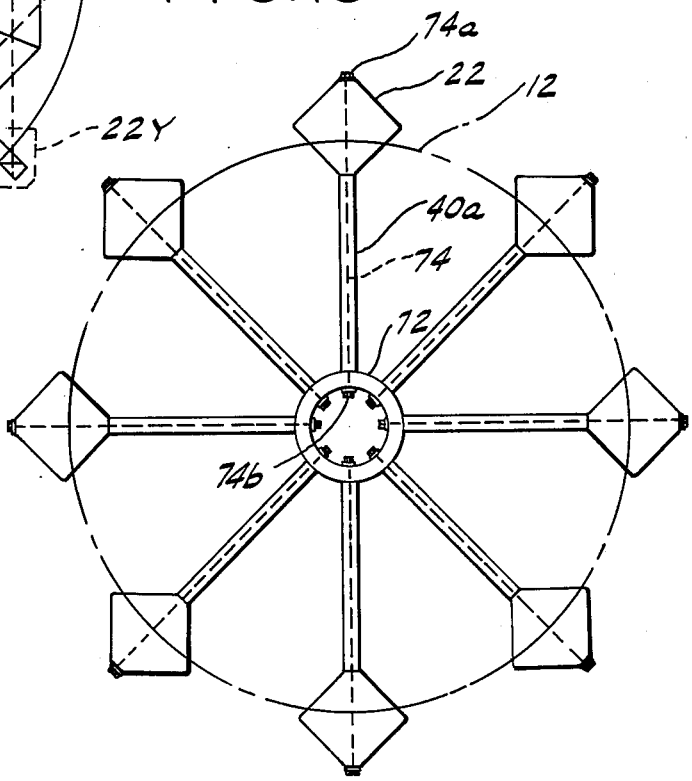

FIGS. 14 and 15 schematically illustrate other tank floor embodiments. In FIG. 14 the tank floor 14*a* is shown as constructed of precast concrete sections 66 of various trapezoidal configurations and a central octagonal precast concrete section 68; all sections 66 and 68 interfit to form the main portion of continuous floor 14*a*. The peripheral areas between sections 66 and tank wall 12 is filled with poured-in-place concrete. The sections 66 are post-tensioned to provide for a strengthened floor structure by means of tensioned rods 70 extending from peripherally alternate footings 22, for example, from footing 22*x* to footing 22*y* through passages in the precast concrete sections 66. It is noted that any combination of the section configurations 66 shown in FIG. 14 will produce a satisfactory tank floor. For example, the tank floor may be comprised entirely of sections having a configuration indicated by numeral 66*a*, or entirely of sections having a configuration indicated by numeral 66*b*, or any interfitting combination of the configurations illustrated.

FIG. 15 shows a stabilizing substructure for the floor embodiments taught by FIG. 14. The stabilizing substructure consists of a plurality of precast concrete spokes 40*a* extending between a respective footing 22 and a central annular reinforced concrete member 72. A metal reinforcing rod 74 running longitudinally through each of the spokes 40*a* is tensioned between a respective footing 22 and member 72 by means of a conventional anchoring nuts 74*a* and 74*b* placed on the ends thereof.

Figure 2:
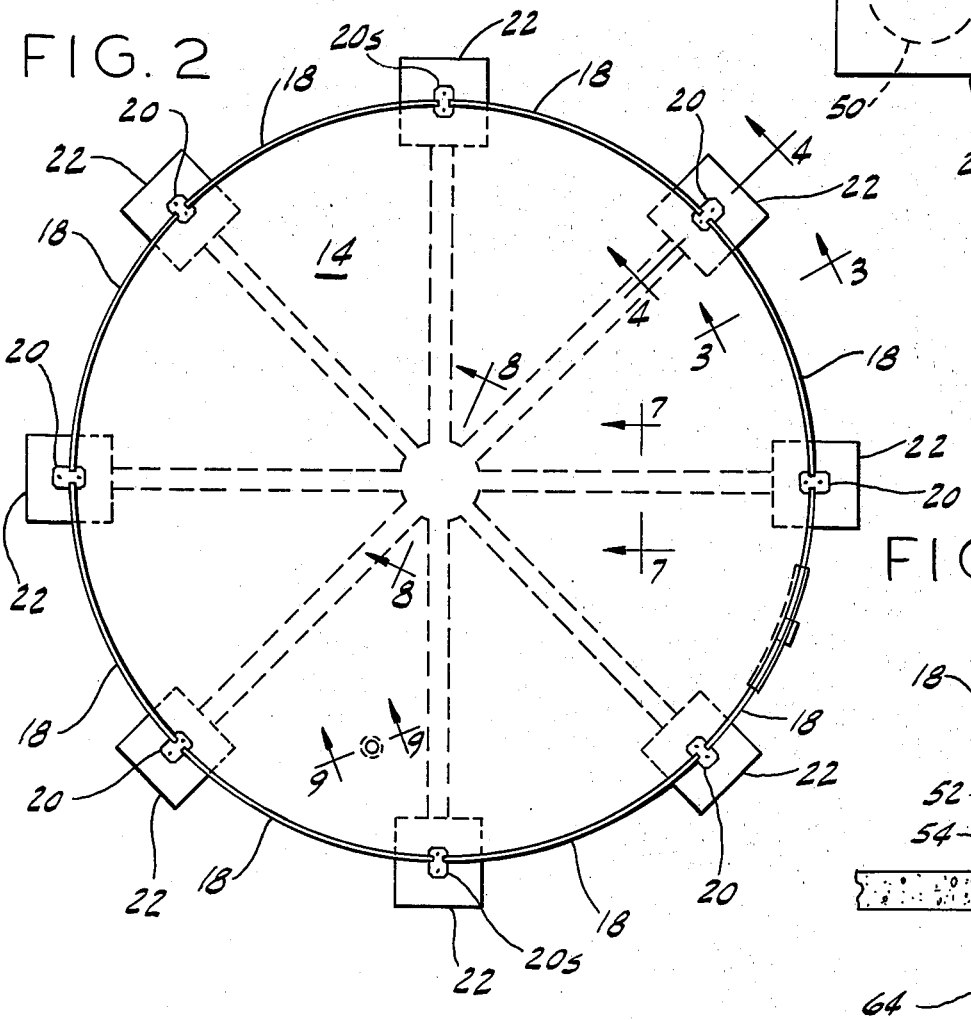
FIG. 2 is a top plan view of the tank.

It is contemplated that the structures illustrated in FIG. 15 or FIG. 2 may also be utilized in conjunction with an overlying liquid-impervious sheet material (not shown) to produce another acceptable tank floor structure. If desired, the liquid-impervious sheet may extend up the tank wall to seal same and be supported by means on top of the tank wall. This would eliminate the necessity for a full concrete floor structure, and the precast spokes 40*a* will maintain dimensional stability and the tank's capacity to resist seismic loading.

It is evident that according to the application of the tank, it may be utilized with or without any of various roof or cover structures. In the case of a manure bank, the manure forms an upper dried crust which acts as a floating cover eliminating the need for a tank roof construction.

The fabrication of a tank according to the principles of the invention is relatively simple. After the footings 22, which may be precast or poured-in-place, are placed in a circular pattern, the desired number of pilaster sections 20*a* through 20*d* are secured to the respective footing and to each other by means of connecting rods 24 and sleeve connectors 26. An equal number of wall panel sections 18*a* through 18*d* are placed between peripherally adjacent pilasters 20, adjacent ends of wall panels 18 being supported on footings 22. Thereafter, tendons 16 are threaded horizontally through selected cross bores 34 of the non-stressing pilasters, and the ends of tendons 16 are tensioned simultaneously from both ends at any one level through bores 34*a* and 34*b* of diametrically opposed stressing pilasters 20*s* and secured therein. Thereafter, any of the various floor structures described hereinabove may be fabricated within the confines of the tank wall along with the appropriate stabilizing substructure. Again, it is stressed that the tank wall itself provides the form for the poured concrete of floor 14. If it is subsequently desired to increase the tank capacity, it is merely necessary to add one or more layers of pilaster and wall panel sections to the top of the tank and pre-stress the additional portion in like manner. It should also be understood that a tank may e constructed to a height equal to only a single pilaster and wall panel section.

If it is desired to relocate a constructed storage tank as hereinabove set forth, it is clear that after the tensioned tendons have been detension, the wall structure can easily be dismantled and the same modular concrete materials utilized to form the tank wall in the new location.

Due to the fact that only concrete is exposed to the material stored, the tank is not subject to corrosion and failure resulting therefrom. Also, if one wall panel should crack or otherwise fail, the majority of the remaining panels will remain intact as a result of the independent pilaster support structure, thus the tank is not subject to progressive failure.

It can thus be appreciated that the novel modular construction described hereinabove produces an economical tank which is structually engineered for maximum strength and stability while requiring a minimum of labor and equipment for construction; it can withstand seismic loading and is not subject to progressive failure; it is versatile in application since it is non-corrosive; it may be easily modified to increase the volume thereof and may be readily dismantled and relocated if desired.

Inasmuch as numerous modifications may be made to the construction of the present invention without departing from the spirit and scope thereof, it is requested that the scope of the invention be determined solely by the claims appended hereto.

We claim:

1. A tank structure comprising:

a plurality of wall panels having vertically extending end edges and horizontally extending top and bottom surfaces:

said wall panels being arcuate in horizontal cross section:

a plurality of vertical pilasters;

said wall panels being placed edge to edge with one of said pilasters located therebetween to form a substantially cylindrical tank wall;

a plurality of vertically spaced tensioned tendons on the exterior of said panels for prestressing said tank wall;

said wall panels being formed of a plurality of substantially-identical, vertically-stacked, precast-concrete wall panel sections, and said pilasters being formed of substantially-identical, vertically-stacked, precast-concrete pilaster sections; and, each of said pilaster sections having a vertical height substantially equal to the height of said wall panel sections.

2. A tank structure as specified in claim 1 and further characterized by:

each of said pilasters being supported by a separate concrete footing having horizontal dimensions greater than the horizontal dimensions of the pilaster supported thereby; and, the end portions of said wall panels being supported by adjacent ones of said footings.

3. A tank structure as specified in claim 2 and further characterized by:

said footings being formed of precast concrete.

4. A tank structure as specified in claim 1 and further characterized by:

each of said pilaster sections having at least one vertical passage therethrough;

rod means in said passage; and, vertically adjacent pilaster sections being secured to one another by means of a connector member joining the adjacent ends of respective rod means.

5. A tank structure as specified in claim 4 and further characterized by:

each of said pilaster sections having two vertical passages therethrough; said passages being radially spaced with respect to said cylindrical tank wall;

rod means passing through each of said passages; and said rod means being post-tensioned.

6. A tank structure as specified in claim 5 and further characterized by:

the lowermost pilaster section of each pilaster being secured to a respective footing by means of a pair of connectors secured to means partially embedded in said respective footing and each of said connectors being joined to an end of a respective one of said rod means.

7. A tank structure as specified in claim 1 and further characterized by:

the majority of said pilasters being nonstressing pilasters each having a rear portion extending radially beyond adjacent ones of said wall panels and having a plurality of vertically spaced bores through said rear portion; and, said tensioned tendons passing through selected ones of said spaced bores substantially flush with the exterior of said wall panels.

8. A tank structure as specified in claim 1 and further characterized by:

said pilasters including at least two diametrically opposed stressing pilasters each having a rear portion extending radially beyond adjacent ones of said wall panels and having a plurality of bores through said rear portions of said stressing pilasters;

said bores being angled with respect to said wall panels to receive the end portions of said tensioned tendons; and, means associated with said stressing pilasters for holding said tendon end portions after said tendons have been tensioned.

9. A tank structure as specified in claim 2 and further characterized by:

a tank floor formed entirely within the confines of said tank wall.

10. A tank structure as specified in claim 1 and further characterized by:

an outlet port formed in said tank wall adjacent the bottom thereof;

a metal bracket on the exterior of said wall and a bore therethrough;

said bracket having an outwardly extending lip portion surrounding said bore and an annular flange porton extending around said lip portion;

said flange portion being connected to said wall in a location providing a continuous passageway through said outlet port; and, said tensioned tendons running adjacent to said outlet port being diverted above and below said outlet port by said lip portion.

11. A tank structure as specified in claim 10 and further characterized by:

a frost wall positioned below said tank wall at the location of said outlet port and extending downwardly into the ground below the earth frost line.

12. A tank structure as specified in claim 2 and further characterized by:

said footings each being formed of a rectangular upper portion and a plurality of cylindrical pier portions extending downwardly therefrom; and, the diameter of each of said cylindrical pier portions being equal to or less than 18 inches.

13. A tank structure as specified in claim 9 and further characterized by:

a stabilizing substructure beneath the upper surface of said tank floor;

said substructure including a central hub located at the center of said tank and a rigid spoke connected radially between said hub and each of said footings.

14. The method of constructing a storage tank comprising the steps of:

positioning a plurality of footings in a circular pattern;

securing a vertically extending pilaster section onto each of said footings;

placing arcuate wall panel sections, of equal height with the pilaster sections, between adjacent pilaster sections so that the end portions of said wall panel sections rest on respective ones of said footings;

securing at least one other substantially identical pilaster section to the top of each of the first-mentioned pilaster sections;

placing at least one other substantially identical wall panel section on top of each of the first-mentioned wall panel sections and betwen adjacent ones of the last-mentioned pilaster sections; and, tensioning vertically spaced tendons around the periphery of said panel sections 15. The method of claim 14 and further including the step of:

fabricating a tank floor entirely within the confines of the tank wall as defined by said wall panel sections.

16. A tank structure comprising:

a plurality of wall panels having vertically extending end edges and horizontally extending top and bottom surfaces;

said wall panels being arcuate in horizontal cross section;

a plurality of vertical pilasters;

said wall panels being placed edge to edge with one of said pilasters located therebetween to form a substantially cylindrical tank wall;

a plurality of vertically-spaced, tensioned tendons on the exterior of said panels for prestressing said tank wall;

each of said pilasters being supported by a separate concrete footing having horizontal dimensions greater than the horizontal dimensions of the pilaster supported thereby;

the end portions of said wall panels being supported by adjacent ones of said footings;

a tank floor formed within the confines of said tank wall;

a stabilizing substructure beneath the upper structure of said tank floor;

said substructure including a central hub located at the center of said tank and a rigid spoke connected radially between said hub and each of said footings.

17. A tank structure as specified in claim 16 and further characterized by:

said tank floor being formed of poured-in-place concrete and said spokes being formed by elongated, downwardly projecting spoke portions integral with said tank floor and said hub being formed by a downwardly projecting hub portion integral with said tank floor; and, a reinforcing bar structure within each of said spoke portions connecting a respective footing to said hub portion.

18. A tank structure as specified in claim 19 and further characterized by:

said tank floor being formed at least in part by interfitting precast concrete elements;

said stabilizing substructure including a plurality of elongated precase concrete spokes radially positioned beneath said elements;

said annular hub member centrall located beneath said elements; and, a post-tensioned metal bar through each of said spokes connecting a respective one of said footings to said hub member.

19. A tank structure as specified in claim 18 and further characterized by:

said elements being forced together by post-tensioned metal bars running through at least some of said elements between peripherally alternate ones of said footings.

20. A tank structure as specified in claim 16 and further characterized by:

said tank floor being formed at least in part by a sheet of liquid-impervious material;

said stabilizing substructure including a plurality of elongated precase concrete spokes radially positioned beneath said sheet;

said annular hub member centrally located beneath said sheet;

a post-tensioned metal bar through each of said spokes connecting a respective one of said footings to said hub member.

21. A tank structure as specified in claim 20 and further characterized by:

said sheet material further providing a liquid-impervious liner for the interior of said tank wall; and, means on said tank wall for supporting the vertical extent of said liner.

* * * * *